United States Patent [19]

Calamia et al.

[11] Patent Number: 4,999,936

[45] Date of Patent: Mar. 19, 1991

[54] ILLUMINATED SIGN

[76] Inventors: Thomas J. Calamia, 8802 Fairview Ave., San Gabriel, Calif. 91775; David W. Fairfield, 8460 Brier Dr., Los Angeles, Calif. 90046

[21] Appl. No.: 459,744

[22] PCT Filed: Apr. 24, 1988

[86] PCT No.: PCT/US88/01329

§ 371 Date: Dec. 22, 1989

§ 102(e) Date: Dec. 22, 1989

[87] PCT Pub. No.: WO89/10607

PCT Pub. Date: Nov. 2, 1989

[51] Int. Cl.[5] ..... G09F 13/22

[52] U.S. Cl. ..... 40/544; 313/502; 313/510; 313/512

[58] Field of Search ..... 40/544; 362/103, 105, 362/106, 108; 428/690; 313/502, 509, 510, 511, 512

[56] References Cited

U.S. PATENT DOCUMENTS 2,721,808 10/1955 Roberts et al. ..... 40/544 X 3,104,339 9/1963 Koury ..... 313/502

3,110,837 12/1963 Wollentin ..... 313/512

4,645,970 2/1987 Murphy ..... 313/509

*Primary Examiner*—Robert P. Swiatek

*Attorney, Agent, or Firm*—Albert O. Cota

[57] ABSTRACT

An illuminated sign (10) that produces a luminescent display that is especially suitable for attachment to an article of clothing such as a jacket (60) or cap (70). The sign (10) consists of an electroluminescent lamp (12) that produces a luminescent cool light, in either, white, yellow or green/blue, that is visible through the openings of an indicia stencil (26) affixed to the front of the lamp (12). The lamp is encapsulated in a film (24) that is further protected by a sign protecting cover (28) having an opening (30) into which is inserted the stencil (26). The signs power circuit consists of an inverter (46) that is powered by a battery (44). The inverter produces an output of 140-volts a-c at 400 Hz that is applied directly to the input of the electroluminescent lamp (12) and that is controlled by a power switch (48). The problems inherent with using protruding LEDs and the limitation of the displays that can be made with the LEDs is eliminated by using the stencil (26) in combination with the electroluminescent panel (12).

18 Claims, 3 Drawing Sheets

ILLUMINATED SIGN

TECHNICAL FIELD

The invention pertains to the general field of illuminated signs and more specifically to an illuminated sign that employs an electroluminescent lamp that is particularly adaptable for use with an article of clothing.

BACKGROUND ART

Illuminated signs for use on articles of clothing are worn to advertise a particular store or business, a trademark or other novelty statements. In general, the prior art has disclosed several designs for an illuminated display panel consisting of two or more stacked panels and a power source.

The panel facing the apparel is generally smooth to allow easier attachment and to prevent tearing the apparel surface. The outer panel has a plurality of bores into which is inserted and retained an equal number of light-emitting diodes (LEDs) and in some cases incandescent bulbs. The center panel normally contains the electrical wire routing and any control circuits that may be required to operate the panel. The assembled display panel is powered by a battery that may be located on the panel itself or located externally and connected to the panel by means of an electrical cable. An on-off switch is often provided to control the application of the battery power.

The LEDs or incandescent bulbs used in the prior art must, because of their mounting configuration, protrude from the surface of the display panel. This protrusion can result in a breakage of one or more of the lights if care is not taken in storing and/or using the apparel with the panel. Additionally, the displayed design provided by the LEDs is limited to a series of discontinuous points arranged to define a letter or a curve. Thus, certain complex displays that require continuous sections for ultimate aesthetics cannot be formed as can be easily accomplished with the instant invention.

A search of the prior art did not disclose any patents that read directly on the claims of the instant invention however, the following U.S. patents were considered related:

| U.S. PAT. NO. | INVENTOR | ISSUED | |
|---|---|---|---|
| 4,709,307 | Brandon | 24 November | 1987 |
| 4,570,206 | Deutsch | 11 February | 1986 |
| 4,231,079 | Heminover | 28 October | 1980 |
| 4,164,008 | Miller | 7 August | 1979 |

The Brandon patent discloses an illuminated article of clothing that uses light-emitting diodes (LEDs) to achieve the ornamental lighting pattern. The LEDs are mounted on a printed wiring board that comprises one element of a five element structure that is attached to the article of clothing. A battery is provided for illuminating the LEDs as is a control circuit for controlling the energization of the LEDs. A cable, hidden within the article of clothing, us used to electrically connect the battery power to the LEDs.

The Deutsch patent discloses an article of clothing that includes a flexible panel having a plurality of holes selected to form a pattern. Through the plurality of holes project a similar plurality of electrically illuminable members such as LEDs. The LEDs are connected through a flexible cable to an electrical power source consisting of a battery and complimentary control circuits.

The Heminover patent discloses a hat assembly having a plurality of perforations located over the upper portion of the hat. Into the perforations is inserted an equal plurality of LEDs that project through the perforations for viewing. A power and control circuit is included to energize the LEDs sequentially at a rate to optically simulate motion.

The Miller patent discloses a garment having a plurality of holes into which is inserted and protrudes an equal plurality of LEDs. The LEDs are mounted on a printed circuit board that is attached at the rear of the garment. A circuit means separate from the printed circuit board is provided that controls and powers the LEDs.

DISCLOSURE OF THE INVENTION

The illuminated sign of the instant invention provides a simple method and structure for producing a luminescent display. The display is especially suitable for attachment to an article of clothing, such as a jacket or a cap but can be also attached to a stationary structure as found on an automobile, boat, motorcycle or the like.

The light for the sign is derived from an electroluminescent lamp consisting of a laminated structure of elements that is encapsulated in a protective encapsulating film. One of these elements is the light source which consists of a transparent conductive film having a phosphor coating that when energized, produces a cool light in either a white, yellow or green/blue color. Over the luminescent panel is placed an indicia stencil that has an image cut-out through which the luminescent light from the phosphor panel projects through to show the desired stencil display.

By using a stencil, any configuration of displays, ranging from letters to artistic complex cutouts, can be made and shown. Thus, the problems of trying to create continuous aesthetic displays by using dots of lights as provided by LEDs as used in the prior art is eliminated. The only limitation in using a stencil is that it be thick enough to fit into an opening in a sign protective cover that further protects the entire encapsulated luminescent lamp.

The power and control circuit for the illuminated sign consists of a small inverter that is powered by a d-c power source such as a standard 9-volt transistor battery. The inverter output which is 140 volts a-c at a frequency of 400 Hz, is applied directly, without any further signal conditioning, to the input of the electroluminescent panel. A power switch is included in the battery circuit to allow the inverter power to be easily turned ON or OFF.

In view of the above disclosure, it is the primary object of the invention to provide a sign that produces a bright and continuous luminescent image that can be easily made, controlled and attached to primarily an article of clothing.

In addition to the primary object, it is also an object of the invention to provide a sign that:

- can also be attached to a stationary structure as found on a vehicle such as an automobile, boat or motorcycle,
- has no limit to the artwork that can be cutout on the indicia stencil whose image is displayed by the light projected by the electroluminescent lamp,
- is cost-effective to manufacture and distribute,
- is not size limited, and that is reliable and maintenance free.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 2:
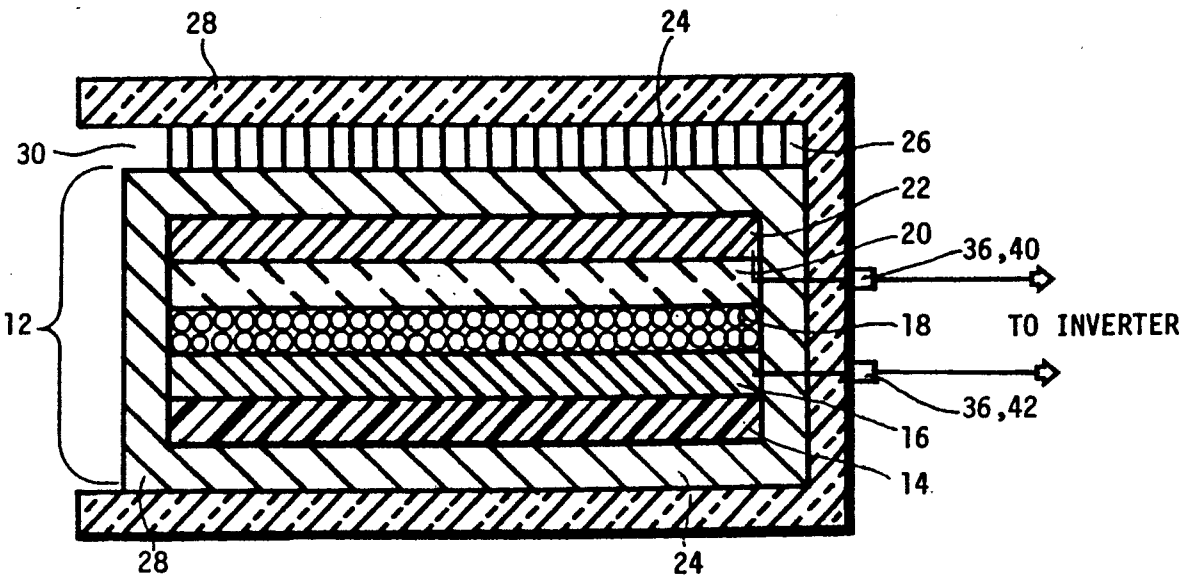
FIG. 2 is a cross sectional view of a typical electroluminescent lamp as used with the illuminated sign.

The best mode for carrying out the illuminated sign is presented in terms of a preferred embodiment that is primarily designed to provide a bright luminescent image that can be attached to an article of clothing or hung on a stationary structure and controlled by means of an onoff power switch.

The preferred embodiment, as shown in FIGS. 1 through 6 is comprised of the following five major elements: an electroluminescent lamp 12, an indicia stencil 26, a power source such as a battery 44, an inverter 46 and a power switch 48.

Figure 1:
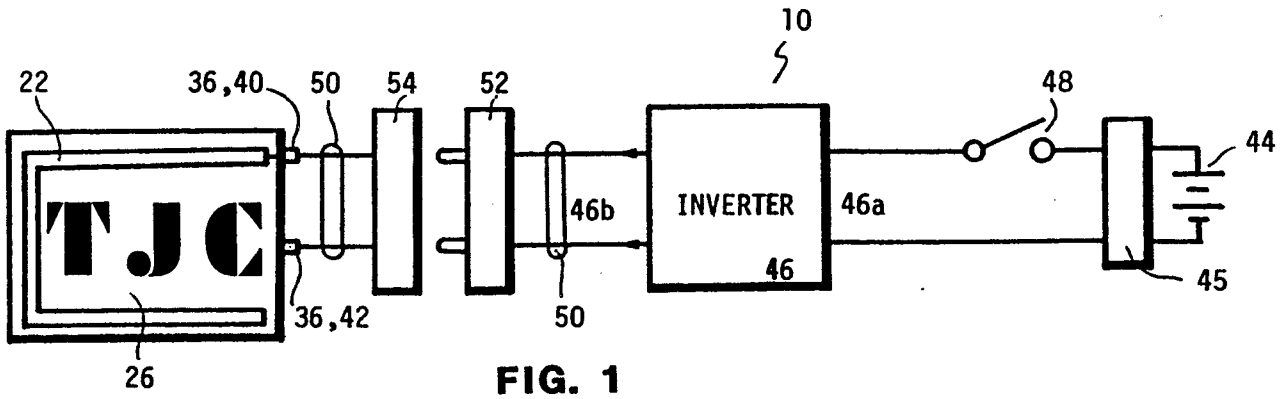
FIG. 1 is a block diagram of the illuminated sign.

The illuminated sign 10 with all its components is shown schematically in FIG. 1. Each of these components is described in detail in the following paragraphs.

Figure 4:
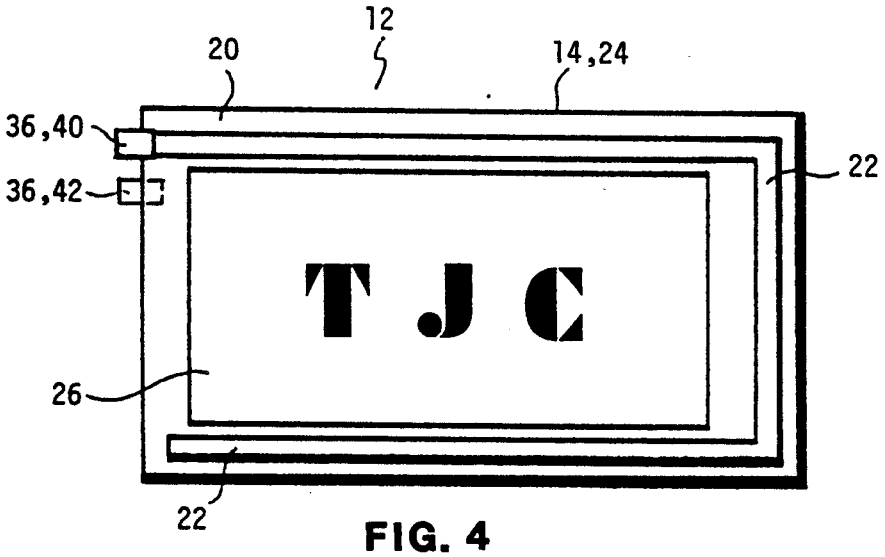
FIG. 4 is a top view of the electroluminescent lamp showing the configuration of the open ended conductive trace and a typical placement of an indicia stencil.
Figure 3:
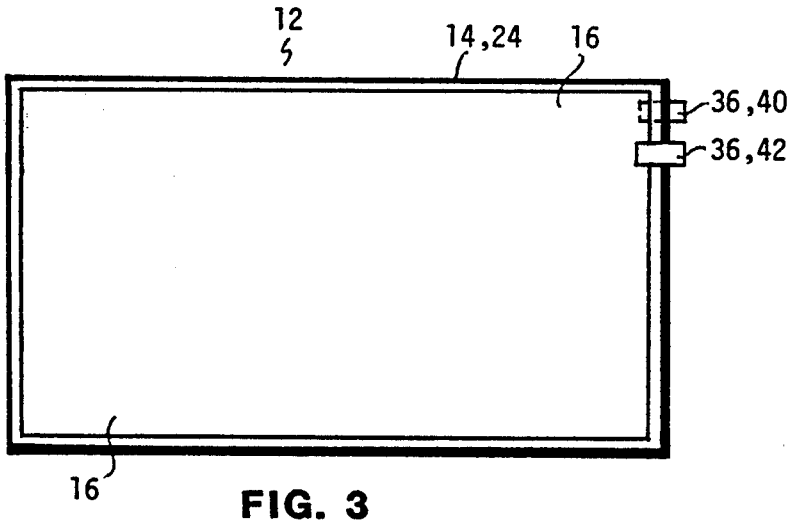
FIG. 3 is a bottom view of the electroluminescent lamp showing the surface of the conductive film.

The electroluminescent lamp 12 is comprised of a laminated structure as shown in FIG. 2. The structure physically consists of five elements. The bottom element is a substrate 14 that is made from a flexible nonconductive material. By a deposition process, the entire upper surface of the substrate 14 is coated with a conductive film 16, such as aluminum or copper, as shown in FIG. 3. On the upper surface of the film 16 is then applied a phosphor coating 18 that is the element that produces a cool light when agitated by the 400 Hz output of the inverter 46. The phosphor can be tinted to provide either a white, yellow or green/blue light. On top of the phospher is then applied a transparent conductive film 20 that has deposited on its surface an open ended conductive trace 22. This trace is applied around the perimeter of the film's upper surface as shown in FIG. 4.

To protect the laminated structure, it is encapsulated with an encapsulating film 24. To complete the illuminated sign, the encapsulated electroluminescent lamp 12 is inserted into a clear sign protective cover 28. This cover has an opening 30 on one end and is sized to fit tightly against the encapsulating film 24. Into the opening 30 is inserted the indicia stencil 26 as shown in FIG. 2. The stencil may be made from any opaque material. However, the material should have a thickness to allow the stencil to fit tightly when held within the cover 28.

The electrical connections to the electroluminescent lamp 12 are accomplished by cutting a slit into the cover 28 and film 24 and attaching a wiring clip 36 to one end of the trace 22. This clip forms the first electrode 40. The second electrode 42 is configured by cutting a slit into the cover 28 and film 24 and attaching a wiring clip 36 to one end of the conductive film 16. Preferably, the first and second electrodes 40, 42 are located near to each other as shown in FIGS. 3 and 4, to facilitate the wire routing.

The power circuit for the illuminated sign 14, as shown in FIG. 1, is provided by a d-c power source that is preferably a battery 44, an inverter 46, having a two terminal input **46*a* and two terminal output 46*b* and a power switch 48. The three components are interconnected by means of a set of two-wire cable assemblies 50**.

When the illuminated sign 10 is used with an article of clothing, such as a jacket 60, cap 70, or a bicycle, the power source may be a standard transistor 9-volt 44 or other battery. Such a battery provides a uselife of between seven to fourteen hours and can easily be concealed in the article of clothing. When the sign 10 is attached to a rigid structure as would be found on an automobile or motorcycle, the vehicles 12-volt battery may be directly employed.

The inverter 46, can be designed to operate with an input of either 9 or 12 volts d-c which then provides an output of 140 volts a-c at 400 Hz. The inverter is housed in a solid, small rugged structure. Preferably, this structure consists of a thin enclosure which allows easier concealment in an article of clothing.

As can be seen in FIG. 1, one of the inverter's inputs **46*a* is connected to one side of the power switch 48. This switch is a single-pole single-throw configuration and preferably is a slide switch. The other side of the switch 48 is connected to one of the terminals on the battery 44. Since this battery is a standard transistor 9-volt battery, the connection from the switch 48 can be made to a standard 9-volt battery receptacle 45. The other battery terminal, via the receptacle 45 and cable assembly 50 is connected to the other input terminal of the inverter 46** to complete the input circuit.

The inverters output **46*b* is connected, via a cable assembly 50 to a plug 52. The plug, in turn, is configured to mate with a receptacle 54. The receptacle is connected, via a cable assembly 50 to the first and second electrodes 40, 42 on the electroluminescent lamp 12** to complete the inverter's output circuit.

Figure 5:
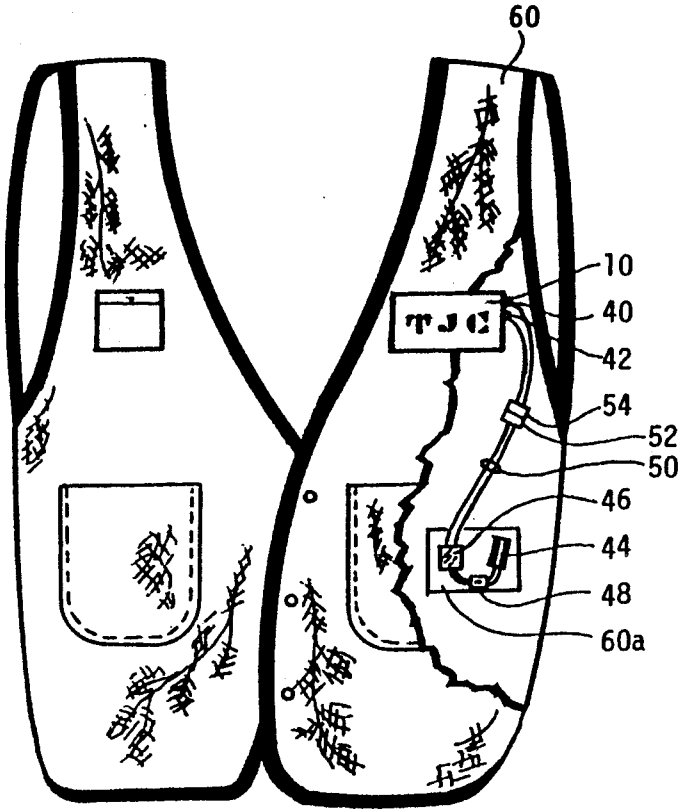
FIG. 5 is a cut-away front view of an illuminated sign and associated components as would be attached to a jacket or vest.
Figure 6:
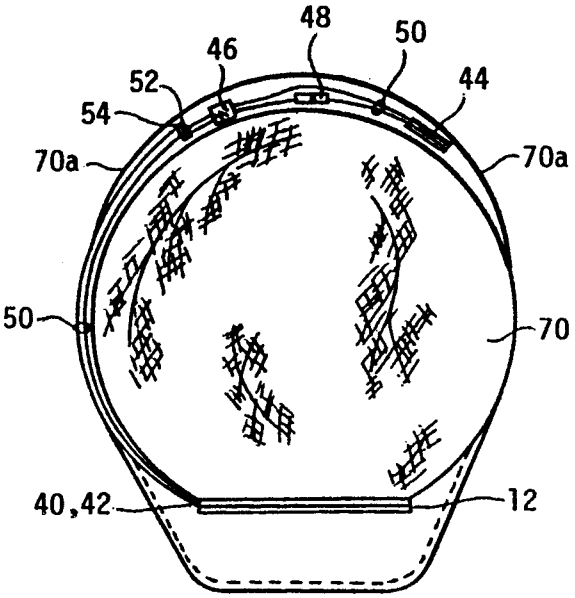
FIG. 6 is a top view of an illuminated sign and associated components as would be attached to a cap having a component retaining enclosure band.

One of the primary uses of the illuminated signs is in its application to an article of clothing such as a vest or jacket 60 as shown in FIG. 5 or a cap 70 as shown in FIG. 6.

The illuminated sign may be attached by applying an adhesive to the back of the sign protective cover 28 and pressing the sign against the articles surface. When the article of clothing is the jacket 60, the cable assemblies 50 from the lamps first and second electrodes 40, 42 are routed inside the jacket to preferably an inside pocket **60*a* housing the battery 44, the inverter 46 and the power switch 48. Likewise, with a cap 70, the routing of the cable assemblies can be either from the side or back of the cap. In some cases, the battery 44 or inverter 46 can be housed within an enclosure band 70*a* located inside or outside the cap. In this case, the cable assembly carrying the power switch 48 would be extended to a position inside a coat or sweater to allow the switch to be manipulated external to the cap. Alternatively, the power switch may also be located within the enclosure band 70*a***.

While the invention has been described in complete detail and pictorially shown in the accompanying drawings it is not to be limited to such details, since many changes and modifications may be made to the invention without departing from the spirit and scope thereof. For example, the illuminated sign may be made in a rectangular or circular shape. The sign 10 is also adaptable for use on store fronts and the battery can be easily replaced by an electronic power supply when space is not a problem. Alternatively, the indicia stencil 26 may be affixed by means of an adhesive, directly to the upper surface of the encapsulating film 24 or the indicia on the stencil may be printed directly on the surface of the encapsulating film 24. Thus the need for the sign protective cover 28 is eliminated. Hence, it is described to cover any and all modifications and forms which may come within the language and scope of the claims.

We claim:

1. An illuminated sign comprising:

a) an electroluminescent lamp comprising a laminated structure having from bottom-to-top a flexible substrate, a conductive film, a phosphor coating, a transparent conductive film and an open-ended conductive trace where said structure is encapsulated within an encapsulated film and with said structure having a first electrode connected to the open-ended conductive trace and a second electrode connected to the conductive film, b) an indicia stencil attached to the upper surface of said electroluminescent lamp, c) a d-c power source, and d) an inverter having its input connected to said d-c power source and its output connected to the first and second electrodes on said electroluminescent lamp.

2. The illuminated sign as specified in claim 1 wherein said electroluminescent lamp further comprises a clear sign protective cover that is sized to completely cover said lamp and having an opening on one side that allows said indicia stencil to be slipped inside.

3. The illuminated sign as specified in claim 1 wherein said illuminated sign is in a rectangular shape.

4. The illuminated sign as specified in claim 1 wherein said illuminated sign is in a circular shape.

5. The illuminated sign as specified in claim 1 wherein said phosphor coating can be tinted to provide a plurality of luminescent colors.

6. The illuminated sign as specified in claim 1 wherein said d-c power source consists of a battery.

7. The illuminated sign as specified in claim 1 wherein said inverter is packaged in a thin enclosure.

8. The illuminated sign as specified in claim 1 further comprising a receptacle attached by a cable assembly to the first and second electrodes on said electroluminescent lamp.

9. The illuminated sign as specified in claim 8 further comprising a plug attached by a cable assembly to the output of said inverter where said plug is configured to mate with said receptacle.

10. The illuminated sign as specified in claim 1 further comprising a power switch connected in series between one input terminal of said inverter and one terminal on said battery.

11. The illuminated sign as specified in claim 1 wherein said illuminated sign is attached to an article of clothing.

12. The illuminated sign as specified in claim 11 wherein said article of clothing comprises a jacket.

13. The illuminated sign as specified in claim 11 wherein said article of clothing comprises a cap.

14. The illuminated sign as specified in claim 1 wherein said illuminated sign is attached to a rigid structure such as found on vehicles.

15. An illuminated sign comprising:

a) an electroluminescent lamp comprising a laminated structure having from bottom-to-top a flexible substrate, a conductive film, a phosphor coating, a transparent conductive film and an open-ended conductive trace where said structure is encapsulated within an encapsulated film and with said structure having a first electrode connected to the open-ended conductive trace and a second electrode connected to the conductive film, b) an indicia stencil attached to the upper surface of said electroluminescent lamp, c) a clear sign protection cover that is sized to completely cover said luminescent lamp and having an opening on one side that allows said indicia stencil to be slipped inside, d) a receptacle connected by means of a two-wire cable assembly to the first and second electrodes on said electroluminescent lamp, e) a power switch consisting of a single-pole single-throw switch, f) a 9-volt battery, g) an inverter having a two-terminal input and a two-terminal output where one of the inputs is connected to one side of said power switch where other side of said switch is connected to one of the terminals on said battery where other terminal of said battery is connected to the other input terminal of said inverter, and where the output of said inverter is connected to a plug, via a cable assembly, where said plug is configured to mate with said receptacle, and h) said illuminated sign is attached to either the front or back of an article of clothing with said indicia facing outwardly and where said battery switch and inverter are located, out-of-view within said clothing.

16. The illuminated sign as specified in claim 15 wherein said article of clothing comprises of a jacket.

17. The illuminated sign as specified in claim 15 wherein said article of clothing comprises a cap.

18. The illuminated sign as specified in claim 15 wherein said indicia stencil is affixed directly to the upper surface of the encapsulating film by means of an adhesive.

* * * * *